United States Patent [19]

Young

[11] 4,008,643

[45] Feb. 22, 1977

[54] KNOTLESS TATTING

[76] Inventor: Dora M. Young, 128 Rogers Road, Kittery, Maine 03904

[22] Filed: Nov. 24, 1975

[21] Appl. No.: 634,873

[52] U.S. Cl. ..... 87/10; 87/52

[51] Int. Cl.[2] ..... D04C 1/00

[58] Field of Search ..... 87/3, 4, 10, 52, 58, 87/59; 289/1–5

[56] References Cited

UNITED STATES PATENTS

| | | | |
|---|---|---|---|
| 31,624 | 3/1861 | Randall | 87/52 |
| 1,490,176 | 4/1924 | Mason et al. | 87/52 X |
| 1,583,273 | 5/1926 | Bosebeck | 87/10 |
| 1,637,716 | 8/1927 | Turck | 87/10 |

*Primary Examiner*—John Petrakes

*Attorney, Agent, or Firm*—Morse, Altman, Oates & Bello

[57] ABSTRACT

A method is disclosed for performing lace-like handwork using thread and at least one hand-held shuttle carrying a supply of thread. The method comprises a knotless tatting technique involving a series of double stitches arranged along a single thread. Holding the work in one hand the shuttle in the other, the thread extending between the work and the shuttle is looped over the fingers of the one hand and the shuttle passed over the loop towards the one hand and returned through the loop and under the loose shuttle thread, pulling the shuttle back towards the other hand, tightening the thread and then slipping the loop under the top of the shuttle, and then sliding it into place against the work. The operation is repeated in the reverse order to complete the double stitch. Picots are formed by leaving spaces between double stitches and a series of double stitches may be formed into rings, the rings in turn, being joined with other rings and/or chains in various designs. Also disclosed are products made by the tatting methods.

2 Claims, 64 Drawing Figures

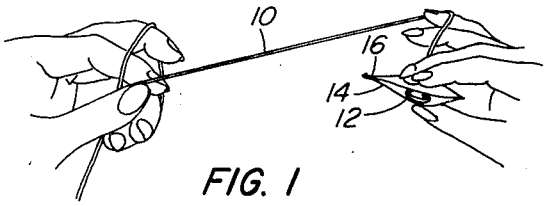
FIG. 1
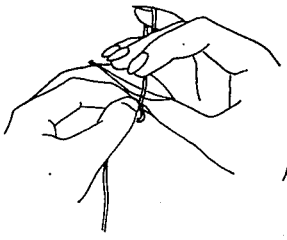
FIG. 2(A)
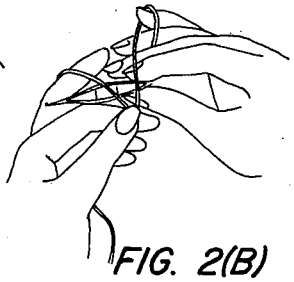
FIG. 2(B)
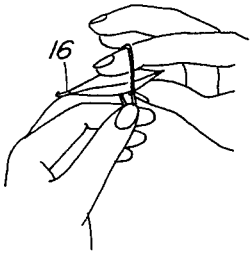
FIG. 2(C)
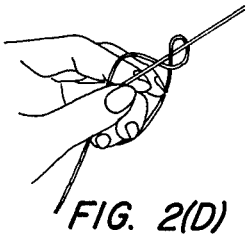
FIG. 2(D)
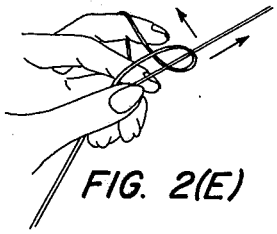
FIG. 2(E)
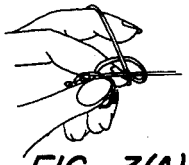
FIG. 3(A)
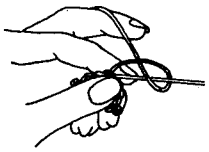
FIG. 3(B)
FIG. 4
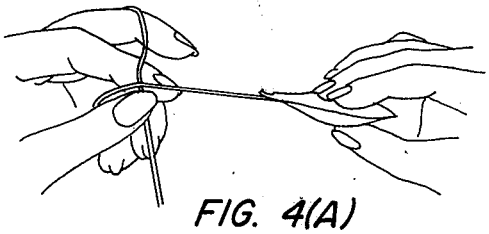
FIG. 4(A)
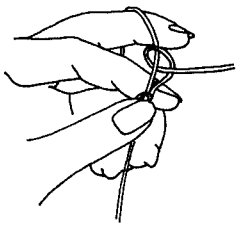
FIG. 4(B)
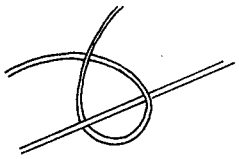
FIG. 4(C)
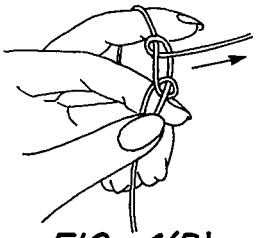
FIG. 4(D)
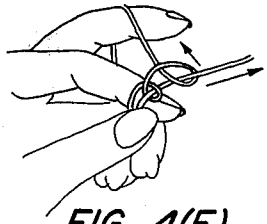
FIG. 4(E)
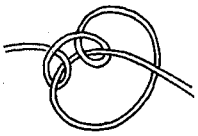
FIG. 4(F)
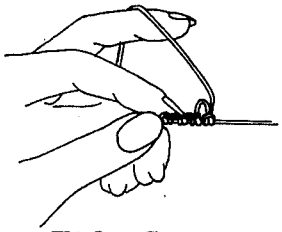
FIG. 5
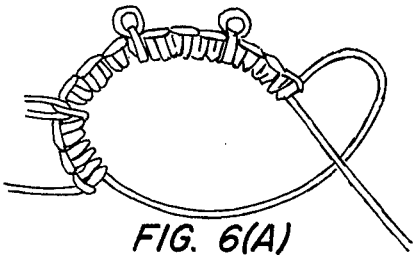
FIG. 6(A)
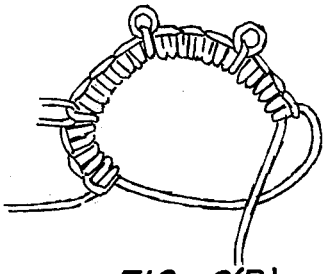
FIG. 6(B)

FIG. 7
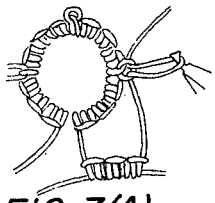
FIG. 7(A)
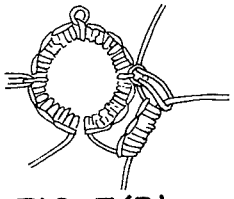
FIG. 7(B)
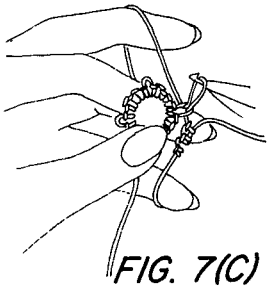
FIG. 7(C)
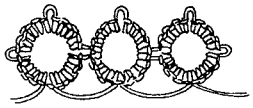
FIG. 7(D)
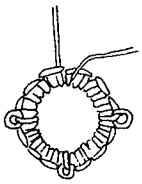
FIG. 8(A)
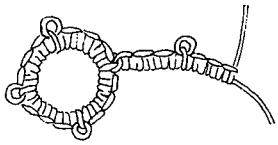
FIG. 8(B)
FIG. 9
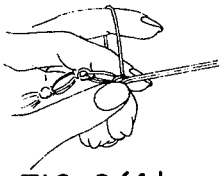
FIG. 9(A)
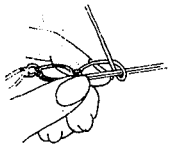
FIG. 9(B)
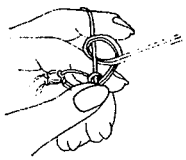
FIG. 9(C)
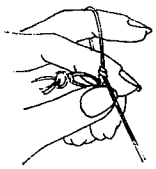
FIG. 9(D)
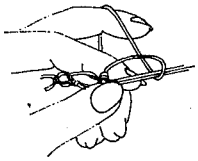
FIG. 9(E)
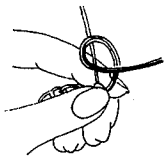
FIG. 9 (F)
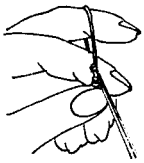
FIG. 9(G)
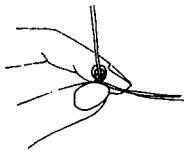
FIG. 9(H)
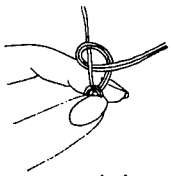
FIG. 9(I)
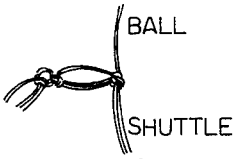
FIG. 9(J)
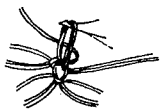
FIG. 9(K)
FIG. 10
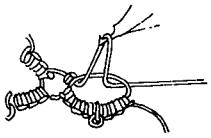
FIG. 10(G)
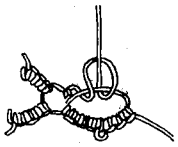
FIG. 10(H)
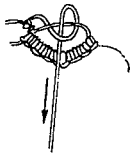
FIG. 10(I)
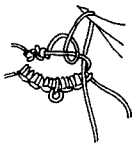
FIG. 10(J)
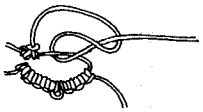
FIG. 10(K)
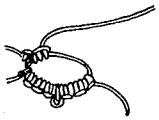
FIG. 10(L)
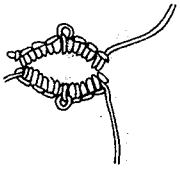
FIG. 10(M)
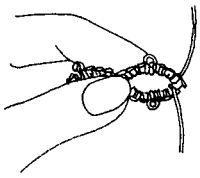
FIG. 10(A)
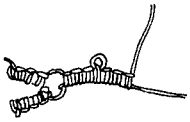
FIG. 10 (B)
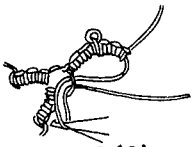
FIG. 10(C)
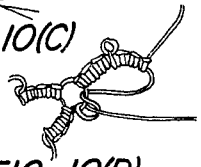
FIG. 10(D)
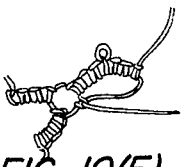
FIG. 10(E)
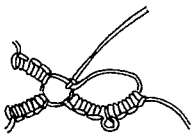
FIG. 10(F)

KNOTLESS TATTING

BACKGROUND OF THE INVENTION

1. Field of the Invention

This invention relates generally to tatting and more particularly is directed towards a new and improved method for making lace-like handwork using knotless techniques and products made thereby.

2. Description of the Prior Art

Tatting is a method of making knotted lace handwork with a small, flat shuttle-shaped instrument from stout cotton thread. The technique has been used for many years to produce decoration edging and trimming as well as for making whole pieces of lacework. This art of tatting has remained virtually unchanged over the years and has enjoyed but limited popularity probably due to the great number of knots that must be made in producing a piece of work.

It is an object of the present invention to provide an improved tatting method which simplifies and expedites tatting procedures. Another object of this invention is to provide a method for performing tatting work which greatly reduces the number of knots needed to produce a work of a size comparable to tat-work done by conventional techniques. A further object of this invention is to provide novel tatted products produced by the new methods.

SUMMARY OF THE INVENTION

This invention features the method of producing lace-like handwork from at least one shuttle, comprising the steps of holding the work in one hand and the shuttle in the other with the connecting thread extending between the shuttle and the one hand. The thread is first looped over the fingers of the one hand and the shuttle is passed over the loop towards the one hand and brought back through the loop and under the loose shuttle thread, pulling the shuttle back away from the work and tightening the thread. The formed loop is then slipped on top of the shuttle thread and then slid against the work. A second stitch is then formed by reversing the same motions to produce a double stitch arranged on a single thread. The operation is repeated to build up a length of double-stitched thread which may be formed into a loop and joined to other loops of a like nature or to form a chain that may be joined to rings and/or chains in various designs. Picots may be formed by leaving spaces between double stitches. This invention also features novel tatting products made by these methods.

BRIEF DESCRIPTION OF THE DRAWINGS

FIG. 1 is a view in perspective showing the proper start position for performing the tatting method according to the invention, FIGS. 2(*a*) through 2(*e*) are views similar to FIG. 1 showing the sequence of steps for making a basic tatting stitch, FIGS. 3(*a*) and 3(*b*) illustrate the technique for making a double stitch in the formation of a ring, FIGS. 4(*a*) through 4(*f*) illustrate the method of making a double stitch, FIG. 5 illustrate the technique of making a picot, FIGS. 6(*a*) and 6(*b*) illustrate the technique for making and closing a ring from a series of double stitches and picots, FIGS. 7(*a*) through 7(*d*) illustrate the technique for joining rings, FIGS. 8(*a*) and 8(*b*) illustrate the joining rings and chains, FIGS. 9(*a*) through 9(*k*) illustrate the method of making a knot stitch according to the invention, FIGS. 10(*a*) through 10(*m*) illustrate the making of a knotless method ring according to the invention, FIGS. 11(*a*) through 11(*k*) illustrate the method of making a knotless chain according to the invention.

DETAILED DESCRIPTION OF THE PREFERRED EMBODIMENT

Figure 12:
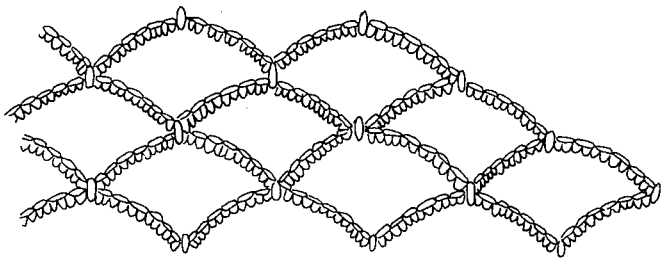
FIG. 12 is a fragmentary view of a workpiece made from a knotless chain according to the invention.

In the drawings, FIGS. 2 through 8 illustrate techniques that are old in the art but are shown for purposes of background information. The remaining figures illustrate techniques and results directly pertinent to the invention.

Tatting, according to common practice, is carried out with thread 10 and preferably regular size ten crochet cotton thread may be used in following the present invention. A supply of thread is carried wound on a bobbin 12 within a shuttle 14 which may have plain ends, a point, or a hook at one end for joining work. Preferably the shuttle is provided with a hook 16 at one end and, in addition, a separate crochet hook 18 is used for joining to small picots and to weave free ends of thread into chains at the end of a piece of work after tying and cutting. When tatting two different colors of thread two separate shuttles are used, one for each color.

By way of general introduction, the work is held in one hand normally the left hand, while the shuttle, connected to the work by a length of shuttle thread, is held in the opposite right hand. Tatting is started by forming a loop with the left hand and the shuttle is passed through the loop in the manner to be described below. To insure proper tatting results, it is important that the right hand holding the shuttle, as soon as it has passed the shuttle through the loop, must stop and tighten the thread, remaining motionless until the left hand has closed the stitch by raising the two middle fingers up until the thread slips to the top of the shuttle thread and slides to the left, being held in place with the thumb and forefingers. The second half of a double stitch is already in top place of the shuttle thread and needs only to be drawn to the left to the first half of the stitch.

FIG. 1 shows the position of the thread and shuttle for the start of the tatting operation. FIG. 2(*a*) shows the manner for sliding the shuttle point end first from the right hand to the left hand. In FIG. 2(*b*) there is shown the technique for sliding the shuttle all of the way under the loop in the left hand, while FIG. 2(*c*) shows the manner for bringing the shuttle back over to the right between the loop and the loose shuttle thread. In FIG. 2(*d*) the shuttle thread is shown being pulled to the right and held in position, while in FIG. 2(*e*) there is shown the step in which the second finger of the left hand is raised, slipping the loop thread to the top of the shuttle thread and then sliding it to the left in place.

FIGS. 3(*a*) and 3(*b*) show further steps for tatting, with FIG. 3(*b*) illustrating the first half of a knot on top of the shuttle thread, while FIG. 3(*a*) shows a second half of the knot on top of the shuttle thread. FIG. 4(*a*) shows another start position, while FIG. 4(*b*) shows the position of the thread after slipping the shuttle through and ready to be tightened. FIG. 4(*c*) shows the threads after tightening up the shuttle thread and the loop slipped to the top of the thread. FIG. 4(*d*) shows the position of the loops before slipping to the top of the thread. FIG. 4(*e*) shows the position of the threads after tightening the shuttle thread with the loop slipping to the top as the fingers are raised. FIG. 4(*f*) shows the correct position of the thread while FIG. 5 shows the finger and thread positions, the loops being slid to the left prior to the repeating of all steps. FIG. 6(*a*) shows completed stitches for a ring ready to be closed, while FIG. 6(*b*) shows the pulling of the shuttle thread to the left to close the ring. FIG. 7(*a*) shows a closed ring and the start of a second ring. FIG. 7(*b*) shows the joining of the second ring to the picot of the former ring. FIG. 7(*c*) shows the slipping at the shuttle point through the picot to pick up the thread to join, while FIG. 7(*d*) shows completed and joined rings. FIG. 8(*a*) shows a completed ring working with a ball for a chain, while FIG. 8(*b*) shows a completed ring and chain.

Tatting, according to the present invention, involves the performance of certain steps, including the joining of rings and chains in various designs, the making of a knot stitch, the making of knotless method rings and chains in the form of trim work or solid work and may be combined with old techniques for making the double stitch, picots and rings, for example. All other steps in tatting depend on how the work is held and how the joinings are made. Normally, the work is held in the left hand but may be thrown over the hand with the thumb and forefinger holding the section being worked upon or it may be held in the palm of the hand and worked on the same finger with thread around the fingers of the left hand. One chain, which is a series of stitches along the same thread length, may be joined in one position and the very next chain in the opposite position. Rings, which comprise a circular formation of stitches, may be joined in the same way.

Making A Double Stitch

Tatting consists of a series of double stitches or tiny knots arranged on a single thread. In order to make one of these stitches, the tatter loops the thread, which extends from the shuttle held in the right hand, over the fingers of the left hand in the manner illustrated in FIGS. 1 and 4(*a*). The shuttle is then slid point end first under the loop (FIG. 4(*b*) all the way towards the left hand, bringing it back over and to the right, through the loop and under the loose shuttle thread, pulling the shuttle back towards the right side, and then tightening the thread. Holding it in a tight position the tatter raises the second finger of the left hand and slips the loop on the thread to the top of the shuttle thread and slides the loop to the left into place, (FIG. 4(*c*) under the thumb and forefinger. The tatter then holds the work in place and reverses the order of the over and the under motion described above in order to form the second half of the stitch. The shuttle thread is then pulled tight, held in position and the loop is tightened to the left next to the first half of the stitch already made. This operation completes a double stitch. The procedure is shown in detail in FIGS. 4(*d*) and 4(*e*). FIG. 4(*f*) illustrates a double stitch before being pulled tight. By repeating the double stitches in the manner described above a series of double stitches may be formed in any desired length either in a straight line chain or formed into a loop.

Making A Picot

In order to make a small loop or picot 18, as shown in FIG. 5, a space is left between adjacent double stitches which are slipped together along the shuttle thread. The size of the picot is determined by the length of the space and the size of the thread used. The picots may be formed at whatever interval is desired between double stitches and, for example, may be formed between every other double stitch or between every three or four double stitches, as desired.

Making A Ring

Referring now to FIGS. 6(*a*) and 6(*b*), there is illustrated the technique for making a ring. The ring is made by tatting a series of four double stitches described above and a picot three times. The stitches are held gently between the left thumb and forefinger and the first and last stitches are brought together. The thread is slipped off the remaining fingers of the left hand leaving a length of thread hanging loosely. The left hand is then turned slightly upward and the shuttle thread is tightened until the first and last stitches meet firmly to form the ring. Space is then left on the thread and the operation is repeated.

Joining The Ring

The technique for joining two or more adjacent rings in any design is illustrated in FIGS. 7(*a*), (*b*), (*c*), and (*d*). The method involves making a first ring in the manner described above, closing the ring but leaving a space on the shuttle thread. Using a crochet hook or the hook of the shuttle slip it through the third or last picot of the first ring, picking up the threads looped over the left hand on the forefinger. The tatter then brings the fingers together and pulls the hook back through the picot until it is large enough to slip the shuttle completely through the loop. The finger of the left hand is then raised until the loop is removed. The second ring is then completed by making four double stitches, a picot, four double stitches another picot, four more double stitches and then closing the ring in the manner described above.

Ring And Chain

Rings and chains which may be used for edging, for example, are formed in the following manner. On a shuttle thread ring formed by four double stitches and a picot repeated three times, the ring is closed and the work is turned. Picking up a ball thread which is held under the ring closure just made and over the fingers of the left hand a chain is formed of five double stitches, a picot and five double stitches in the same manner as for a ring but worked on the shuttle thread. The work is again turned and a ring of four double stitches is made and joined to the third picot of the former ring. Four double stitches and a picot is repeated twice. Four double stitches are then made, the ring is closed, the work turned in a chain of five double stitches, a picot and five double stitches is made and the double work again turned.

The preceding description relates to techniques that are old in the art while the following description pertains to techniques and work in accordance with the invention.

The Reversed Double Stitch

Using a ball and shuttle wind two threads evenly on the shuttle bobbin and cut one thread about 15 inches from the shuttle. The hook is then inserted through the picot of the former round or the hemstitched space of the material which is being worked on. The ball thread is picked up and pulled back through and then pulled into place. The ball thread and the loose end of the shuttle thread are knotted close to the picot or to the space. Approximately ¾ inch space is then left on all threads of one single stitch which is the first half of a double stitch. The second half of the double stitch is made but the finger thread is first pulled tightly. Thereafter pull the shuttle threads tight making a reverse double stitch knot. Then make a picot bringing the thread close to the knot holding it in place with the thumb nail. Then make the first half of a double stitch, followed by the second half of a double stitch using the reverse of the method described above. This knot will not slide on the thread so it is necessary to insure that the picot thread is held in place before proceeding. A space of about ¾ inch is left on the thread and one reverse double stitch is made. This operation is repeated using knotless methods described in the knot stitching directions set forth below.

Making The Knot Stitch

Referring now to FIGS. 9(*a*) through 9(*k*) there is illustrated the technique for making the knot stitch. The knot stitch is made by first tying two threads together and winding them evenly about the bobbin on the shuttle. One of the two threads is then cut 15 inches from the shuttle. The knot stitch is made by using three threads, two of the threads from the shuttle and one from a ball of thread. FIG. 9(*a*) shows the position of the threads and fingers at the start of the knot stitch. Working with the three threads, leave ¾ inch space on all threads and make one reverse double stitch as described above followed by a picot and another reversed double stitch. Again leaving a ¾ inch space on all threads make one reversed double stitch and join it to the picot of a former round or to the end hemstitched space of material being worked on, as the case may be. The number of spaces skipped on hemstitched edges depends on the size of the spaces. The next step is to make a reversed double stitch and repeat the operation from the first reversed double stitch all the way around and using a knotless method on the final knot stitch. Then drop the ball thread leaving ¾ inch space on the thread making one reversed double stitch using the shuttle only. Join to the first picot of the ring or to the hemstitched space on the material, as the case may be, picking up both threads pull them back through the picot and slip the shuttle through the loop, pulling the stitch securely in place. Then join to the first half of the knot stitch just made at the picot and make one reversed double stitch. There will then be four threads on this knot stitch to bring the thread in position for the next round. Care should be taken to keep the shuttle threads as evenly as possible and unwind when necessary. By holding the work up with the left hand with the shuttle dangling, the threads will correct themselves.

The foregoing procedures are illustrated in the FIG. 9 series, wherein it will be seen that 9(*b*) shows the hand and thread positions in which space is left on all three threads in making the first half of the reverse double stitch. In FIG. 9(*c*) the second half of the reverse double stitch is shown as it is being pulled in place. FIG. 9(*d*) shows the completed, reversed double stitch. In FIG. 9(*e*) there is shown the manner for allowing space on the thread for a picot as the first half of a reverse double stitch is being made. FIG. 9(*f*) shows the second half of the reverse double stitch being made, with FIG. 9(*g*) showing the stitch being pulled into place, while the completed reverse double stitch is shown in FIG. 9(*h*). In FIG. 9(*i*) the picot is shown between the thumb and index finger before completing the stitch, while FIG. 9(*j*) shows the completed knot stitch. FIG. 9(*k*) shows the technique for joining a knot stitch to the picot of a former round.

Making A Knotless Method Ring

Referring now to FIGS. 10(*a*) through 10(*m*) there is illustrated the technique for making a knotless method ring according to the invention. The method involves making the first half of a ring as a chain, omitting one double stitch and joining at the base of the chain, the tatter then picks up the shuttle thread, slides the shuttle thread through the loop, pulling it tightly in place and making a slight curve on the chain to resemble one half of a ring followed by pulling a single thread down straight. (See FIG. 10(*a*). Next leave a slight space for the shuttle hook at the base of the chain which has just been made. The work is turned over and, working on the shuttle thread only, insert the hook in the partly completed ring, pick up the shuttle thread and pull it back through. Then slip the shuttle through the loop, pulling it in place but leaving loose the first half of the double stitch just made. Then bring the shuttle hook up through the ring, pick up the shuttle thread beyond the loose stitch and pull it back down through the ring. This causes the loose stitch to slide to the top of the thread. Continue sliding the shuttle through the loop, straightening the shuttle threads slowly until about one inch of the loop remains between the first and second half of the souble stitch, drop the shuttle and take the large loop between the thumb and forefingers of the right hand, pulling firmly in place and then pull the second half firmly in place. One double stitch is then complete. Repeat this series of operations from the point directly after turning over the work to correspond with the stitches of the first half of a ring chain.

By omitting one double stitch on each side of the ring, the resulting ring is made less rigid and less firm than a regular tatted ring, but of a uniform size to correspond with design.

In FIGS. 10(*a*) through 10(*m*) there are illustrations showing the knotless method ring made with a ball and shuttle, with FIG. 10(*a*) showing a completed knotless ring. In FIG. 10(*b*) there is shown a chain with the first half of the ring and omitting one double stitch. In FIG. 10(*c*) there is shown the technique for joining at the base of the chain and picking up the shuttle thread through a loop using a hook. Next, as shown in FIGS. 10(*d*) and 10(*e*), the thread is pulled tightly in place making a slight curve on the chain to resemble half of a ring, then pulling a single thread down straight. Next, the work is turned, as shown in FIG. 10(*f*), and working on a shuttle thread only the hook is inserted in a partly made ring picking up the shuttle thread and pulling it back through the ring, as shown in FIG. 10(*g*). In FIG. 10(*h*) there is shown the position of the work after the shuttle has been slipped through the loop with the threads left loose. Next, the thread is pulled in place but left somewhat loose, as shown in FIG. 10(*i*), which shows the completion of the first half of the reverse double stitch. Next, as shown in FIG. 10(*j*), the shuttle hook is brought up through the ring to pick up the shuttle thread beyond the loose stitch to pull it back down through the ring. This causes the loop stitch to slide to the top of the thread. As shown in FIG. 10(*k*), the tatter continues to slide the shuttle through the loop, straightening the shuttle thread slowly until about one inch of the loop remains. The tatter drops the shuttle, takes the first loop between the thumb and the forefinger of the right hand and pulls it back firmly in place and then pulls the second half in place. FIG. 10(*l*) illustrates a complete single reverse double stitch. By repeating the stitches to correspond with the stitches of the first half of the ring a knotless ring is completed, as shown in FIG. 10(*m*).

Knotless Method Chain

Figure 13:
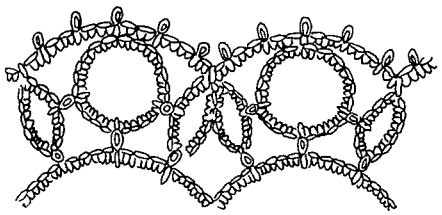
FIG. 13 is a view similar to FIG. 12 showing a work piece made from a combination of chains and rings according to the invention, and, FIG. 14 is a detail plan view of a section of solid work made according to the invention.
Figure 11A:
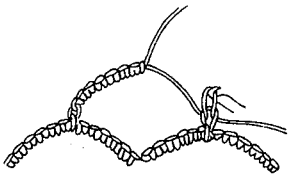
Figure 11F:
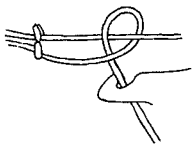
Figure 11G:
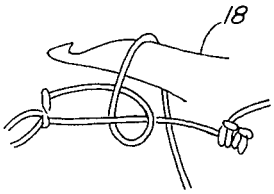
Figure 11H:
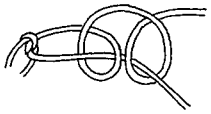
Figure 11B:
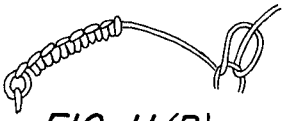
Figure 11I:
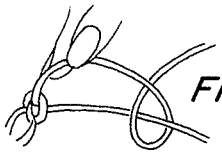
Figure 11C:
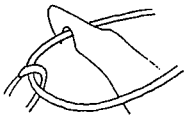
Figure 11J:
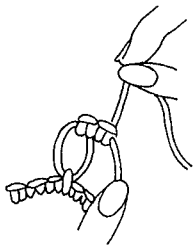
Figure 11K:
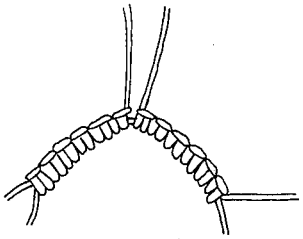
Figure 11D:
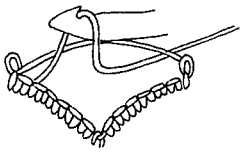
Figure 11E:
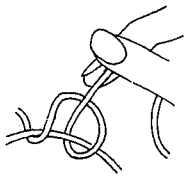

Referring now to FIGS. 11 through 13 there is illustrated the technique for making a chain according to the knotless method of the invention. The knotless method chain is made in a manner similar to the steps in making a knotless method ring previously described, but has no definite style or form. It may be divided in the center with the second half worked in the knotless method, using a ball of thread and a shuttle thread as a picot to start the next round. Tying a square knot allows for spacing of a picot in preparation for the next round to produce a net as illustrated in FIG. 12, for example. In FIG. 13 there is illustrated a different version of this work using the same techniques.

To make the knotless chain the steps of FIGS. 11(*a*) through 11(*k*) are followed. This involves using typically a chain of six double stitches, a picot and six double stitches. After a chain of six double stitches are made drop the shuttle thread and join to the next picot of the former round allowing space for the remainder of the chain, pulling in place and turning the work over. Work should be done using only the shuttle thread.

In FIG. 11(*a*) there is illustrated the step of using the hook 18 to join the chain to the picot of the former round by pulling the shuttle thread through the picot of the round as shown. In FIG. 11(*b*) there is shown the technique of joining in which, after allowing space for the remainder of the chain, the thread is pulled in place. Next, in FIG. 11(*c*), there is shown the step of turning the work over and slipping the shuttle under the chain thread, picking up the shuttle thread with the hook. In FIG. 11(*d*) there is shown the use of the hook to pull the thread back under the chain thread and continue slipping the shuttle through the loop. The thread is then pulled loosely in place. In FIGS. 11(*f*) and (*g*) there is illustrated the step of slipping the shuttle thread in back of and up through the space under the chain, picking up the shuttle thread and reversing the motion. This pulls the first half of the double stitch to the top of the chain thread. Continue slipping the shuttle loop to form the completed stitch as illustrated in FIG. 11(*h*).

In FIG. 11(*i*) there is shown the proper manner for holding the shuttle in the palm of the hand and, using the thumb and forefinger, pull the first half of the double stitch in place and then pull the second half of the double stitch in place to complete making one double stitch. The steps from FIGS. 11(*c*) through 11(*i*) are repeated five more times for the remainder of the chain in the manner shown in FIGS. 11(*j*) and 11(*k*). Then tie a square knot with the shuttle and ball threads, reversing the work and continue for the next round or row.

Tatting on a Hemstitched Edge

The tatting steps may be used in various designs for making an entire work of tatting rings, chains, etc., and may also be used to form a decorative edging or trim along pillow-cases, handkerchiefs and any hemstitched edge. The technique involves the use of a ball of thread and a shuttle of thread and starts by inserting the hook through a space on the hemstitched edge as on the right side of a scallop or on the left corner of a handkerchief as desired. Picking up the ball or shuttle thread, pull the thread back through the space, slipping the shuttle through the loop and pulling in place. A chain of two double stitches is made and joined next to the space in the same manner. Two double stitches are then made and joined to the next space on the right and followed by two more double stitches joined to the next space, repeated three tims, followed by a picot and two double stitches. The steps are repeated from the step directly after the second double stitch and around the corner of the material. The hook is then inserted into a corner space and the shuttle thread only is picked up and pulled in place. A picot is formed be one double stitch and joined in the same space. This is followed by a picot, and a single double stitch joined in the same space. Again a picot, and a double stitch joined in the space. Two double stitches are then made and joined in the next space repeated five times followed by a picot a double stitch and joined in the next space. The steps are repeated from the two double stitches around the edge ending with a picot, one double stitch and joined to the first stitch made.

The foregoing techniques may be used in a wide variety of designs and once the basic configurations are mastered, the different stitches may be combined in various chains, loops and rings into a wide variety of unique decorative items such as place mats, doilies, edgings, etc.

Solid Work

Figure 14:
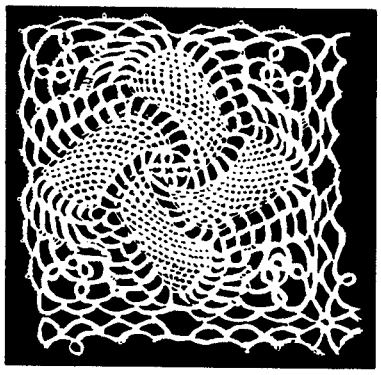

Solid tatting work such as shown in FIG. 14 consists of a picot and double stitch joined to the next picot of a former round. It may be worked in a continuous method without turning work, or can be reversed at the end of each row. Without turning work, the design may be kept uniform, (as a square or rectangle). By reversing the work, it may be decreased one picot at each end resulting in a triangular shape, which may be used as a petal or flower, a leaf or endless solid work designs.

An example of solid work may be produced from the following instructions: Make a chain of 15 picots separated by one double stitch using the knotless method on the final picot and turn the work. Next make a picot and a double stitch joined to the first picot of the former row. Make another picot and double stitch and join to the next picot and repeat this last sequence across to the final picot. Using the knotless method tie and turn the work. Repeat the former row for the desired length, keeping same number of picots on each row.

On spiral solid designs, do not turn the work but continue as above adding one picot and double stitch (or more) on the chain at end of each spiral design as called for in the directions.

Having thus described the invention what I claim and desire to obtain by Letters Patent of the United States is:

1. The method of making a decorative knot stitch in tatting work with three threads and a shuttle having a bobbin thereon, comprising the steps of:

a. tying together a pair of threads and winding them evenly about said bobbin,
b. cutting one of said pair of threads relatively close to the shuttle,
c. forming a first reversed double stitch from said threads at an even spacing on all threads,
d. forming a picot from said threads,
e. forming a second reversed double stitch and joining it to another part of the work adjacent thereto,
f. repeating the reversed double stitches and picots,
g. joining the ends to the work,
h. picking up both threads and passing them through an adjacent picot, slipping the shuttle through the loop, and
i. joining the first half of the last made knot stitch at the picot and one reversed double stitch.

2. The method of making tatting work from thread and a hooked shuttle having a bobbin and a ball of thread, comprising the steps of:

a. winding a pair of threads about said bobbin,
b. trimming one of said threads on the order of 15 inches from said shuttle,
c. inserting said hook through prior work, engaging the ball thread and pulling it back through said work,
d. knotting the ball thread to the trimmed shuttle thread,
e. forming the first half of a double stitch, leaving approximately ¾inch spacing on all threads,
f. forming the second half of the double stitch pulling the thread tightly and making a reverse double stitch knot,
g. forming a picot, and,
h. forming the first and second halves of a double stitch in reverse sequence.

* * * * *